US006575154B1

(12) United States Patent
Freeman, Jr. et al.

(10) Patent No.: US 6,575,154 B1
(45) Date of Patent: Jun. 10, 2003

(54) GAS-FIRED, INFRARED, WARMER

(76) Inventors: Raymond Robert Freeman, Jr., 1764 Norland Rd., Charlotte, NC (US) 28211; Raymond Robert Freeman, III, 1764 Norland Rd., Charlotte, NC (US) 28211

( * ) Notice: Subject to any disclaimer, the term of this patent is extended or adjusted under 35 U.S.C. 154(b) by 0 days.

(21) Appl. No.: 10/136,219

(22) Filed: May 1, 2002

(51) Int. Cl.[7] ..... F24C 3/08

(52) U.S. Cl. ..... 126/40; 126/38; 126/41 R; 126/92 B

(58) Field of Search ..... 126/38, 9 R, 4.5, 126/41 R, 92 R, 92 AC, 92 B, 95, 40; 431/328, 329

(56) References Cited

U.S. PATENT DOCUMENTS

| | | | | | |
|---|---|---|---|---|---|
| 2,832,331 | A | * | 4/1958 | Schwank | 126/41 R |
| 3,103,160 | A | * | 9/1963 | Forniti | 126/38 |
| 3,200,809 | A | * | 8/1965 | Suchowolec | 126/92 B |
| 3,251,355 | A | * | 5/1966 | Keating | 126/41 R |
| 3,586,823 | A | | 6/1971 | Schler | 219/347 |
| 3,763,847 | A | | 10/1973 | Guzdar et al. | 126/92 B |
| 3,895,622 | A | * | 7/1975 | Krueger | 126/38 |
| 4,119,834 | A | | 10/1978 | Losch | 219/354 |
| 4,751,911 | A | | 6/1988 | Betts et al. | 126/261 |
| 4,881,519 | A | | 11/1989 | Henke | 126/21 A |
| 5,094,221 | A | * | 3/1992 | Ho | 126/92 AC |
| 6,111,224 | A | | 8/2000 | Witt | 219/385 |
| 6,146,677 | A | | 11/2000 | Moreth | 426/505 |
| 6,250,210 | B1 | | 6/2001 | Moreth | 99/331 |
| 6,261,621 | B1 | | 7/2001 | Stanger et al. | 426/520 |
| 6,340,298 | B1 | | 1/2002 | Vandrak et al. | 432/222 |

* cited by examiner

*Primary Examiner*—James C. Yeung
(74) *Attorney, Agent, or Firm*—Kennedy, Covington, Lobdell & Hickman, LLP

(57) ABSTRACT

A gas-fired, infrared, food warmer having a gas-fired, infrared, burner adjustably mounted above a surface for supporting food. A reflector encloses the burner and is open at the bottom to expose the food supporting surface to the infrared heat directly from the burner and indirectly from the reflector. A heat shield surrounds the top, sides and ends of the reflector in spaced relation and a perforated protective cover surrounds the top, sides and ends of the heat shield in spaced relation thereto. A gas canister is exchangeably mounted in a housing on the warmer for portability therewith in supplying gas to the burner.

22 Claims, 9 Drawing Sheets

GAS-FIRED, INFRARED, WARMER

The present invention relates to gas-fired, infrared, warmers, and more particularly to gas-fired, infrared, warmers upon which gas supply canisters are mounted.

BACKGROUND OF THE INVENTION

Gas-fired, infrared heaters are commonly used to heat areas and objects such as to warm chicks in poultry houses. Such heaters are capable of being selectively located and relocated, but require a separate source of gas, such as a main supply servicing a plurality of heaters or a separate tank connected by a tube, but not mounted on the heater for movement therewith. As these heaters are typically hung from a ceiling or other elevated support, it has not been desirable or practical to consider mounting the gas supply tank or canister on the heater. Rather, one or more heaters are typically connected to a separate, sometimes remote, gas supply by fuel lines that can be obstructive and/or hazardous. Further, such heaters are not normally mounted on supports or assemblies that themselves have surfaces on which products to be heated or warmed are to be supported for receiving the infrared heat.

Gas is also used to supply fuel to flame-heat grills, such as outdoor cooking grills where the gas is supplied from tanks mounted on the grill for movement or portability with the grill assembly. These gas grills normally use an open flame. Further, while portable, they are not suitable for indoor use or for use as warmers or heaters.

There are commonly used electrically powered infrared, warmers used for keeping food warm in a serving line or buffet. These have limited portability, but are restricted by having to be in proximity to an electrical source connection, with electrical cords extending from the warmers to the electrical connection, the cords being obstructive and/or hazardous. For most practical purposes, such warmers are not usable outdoors. Also, on occasions, such as at tradeshows, where a multitude of warmers are being connected to an electrical supply, there can be problems in the supply of electricity to all of the warmers at one time.

SUMMARY OF THE INVENTION

By the present invention, a warmer is provided that has the advantages of being a gas-fired, infrared, warmer usable indoors or outdoors without requiring connection to a separate power source so that it can be truly portable without any obstructing and/or hazardous fuel or electrical power lines. Broadly stated, the gas-fired, infrared, warmer of the present invention has a base having a product supporting surface, a support member mounted on the base and a gas-fired, infrared heat generating assembly supported by the support member in spaced facing relation to the product supporting surface. The assembly includes a gas-fired, infrared heat generating element and a reflector disposed in spaced relation about the element and open to expose the product supporting surface to infrared heat directly from the heat generating element and indirectly from the reflector. A mounting is provided for replaceably mounting a gas supply canister on the warmer with a gas conduit connectable between the gas canister and the heat generating element. As a result, the warmer of the present invention is self-contained and useable without physical limitation to the location of a fuel or power source, and can be used anywhere, inside or outside and can be moved to and used at any desired location. Using gas rather than electricity results in a much more fuel efficient and environmentally preferable warmer.

In the preferred embodiment, the warmer is advantageously portable, and, therefore, can be used in various locations, indoors or outdoors or anywhere desired, particularly when used by caterers or restaurants where the warmer or warmers are positioned temporarily.

When used as a food warmer, the warmer of the present invention has the product supporting surface in the form of an upwardly facing food supporting surface with the support member projecting upwardly from the surface to a location spaced upwardly from the surface. The gas-fired, infrared heat generating assembly is supported on the support member in facing relation to and above the food supporting surface and includes a gas-fired, infrared heat generating element and a reflector disposed in space relation about the element and opening downwardly to expose the food and the supporting surface to infrared heat directly from the heat generating element and reflected by the reflector.

Preferably, the mounting for the canister is adjacent and, in the preferred embodiment, attached to the upwardly projecting support member, with an upstanding housing enclosing the mounting and providing space for mounting of a gas canister therein. The housing has a door openable to insert and remove gas canisters.

Preferably, the assembly includes a heat shield spaced from and extending about the reflector and, in the preferred embodiment, a protective cover spaced from and extending about the heat shield, with the protective cover being perforated for air circulation.

In the preferred embodiment, the support member is in the form of a pair of spaced, upwardly extending, telescopingly extendible bars, providing for adjustments of the positioning of the heat elements above the food supporting surface.

For control of the generated heat, a conventional on-off valve and gas flow regulator are disposed for controlling gas flow in the conduit connecting the gas canister and the heating element.

With the warmer of the present invention, various products may be warmed and kept warm. Food may be supported in containers for serving or the warmer may be used as a carving station.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENT OF THE PRESENT INVENTION

Figure 1:
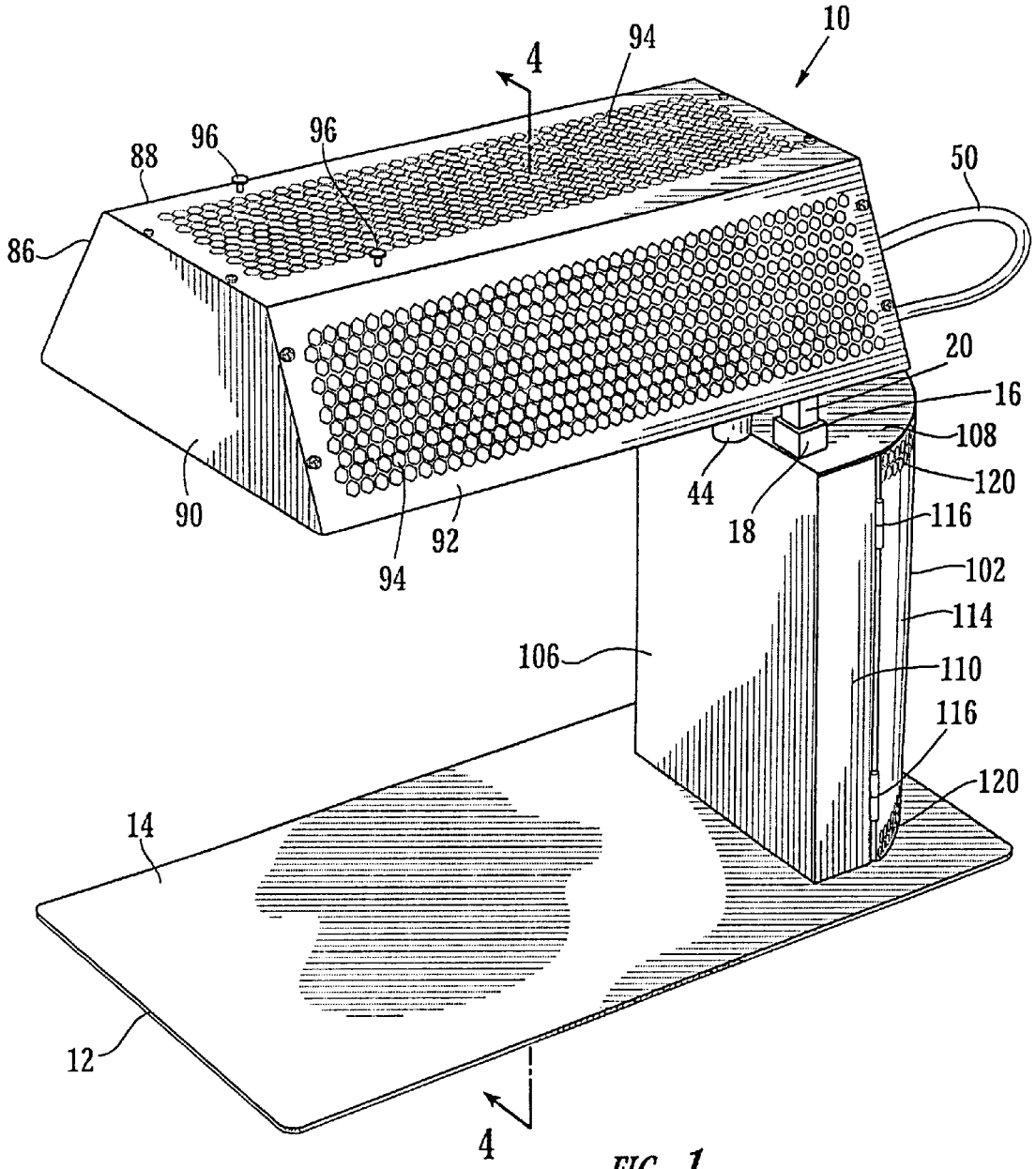
FIG. 1 is a front prospective view of a food warmer according to the preferred embodiment of the present invention.
Figure 2:
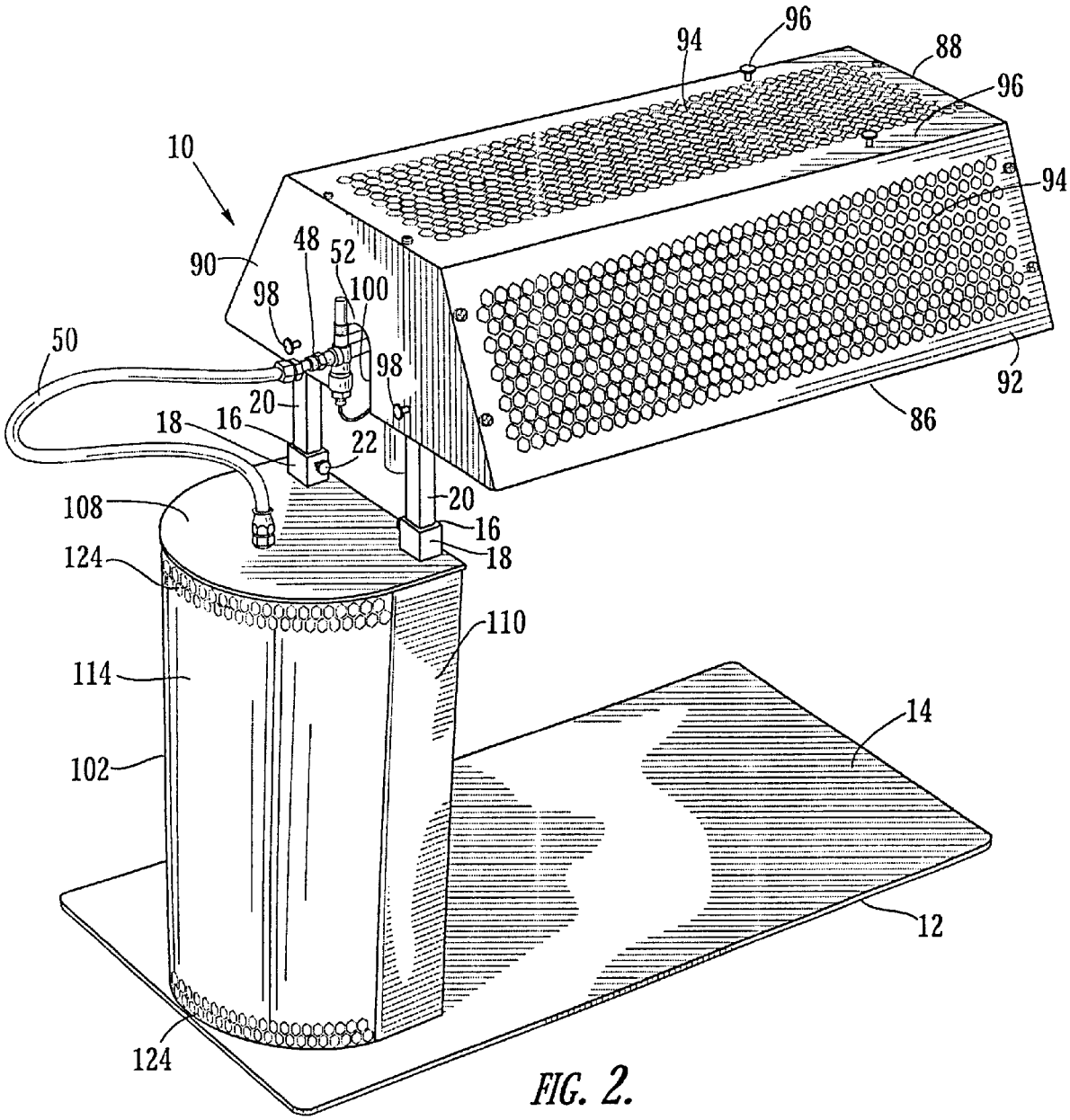
FIG. 2 is a rear prospective view of the food warmer of FIG. 1.
Figure 3:
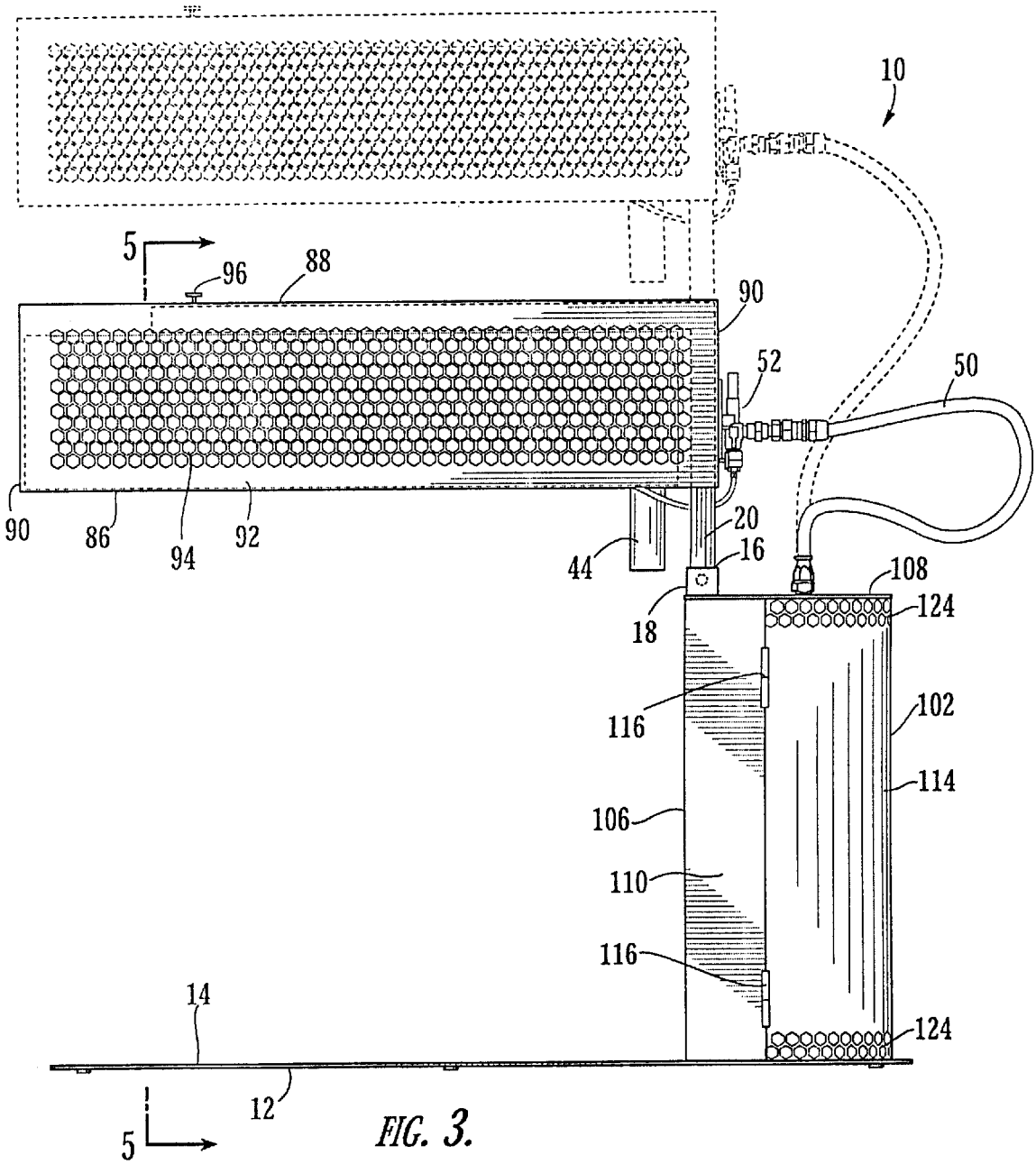
FIG. 3 is a front elevational view of the food warmer of FIG. 1.

As illustrated in the accompanying drawings, the warmer 10 of the preferred embodiment of the present invention has a base 12 in the form of a rectangular plate of sufficient length and width to provide a stable support for the components mounted thereon. The base 12 has an upwardly facing surface 14 for supporting a product, such as food in dishes or meat being carved. Mounted on the base 12 and projecting upwardly therefrom is a support member in the form of a pair of spaced telescopingly extendible bars 16. Each bar has a hollow lower portion 18, square in cross-section, secured to the base 12, and upper portion 20, square in cross-section and configured to be telescopingly receivable in the lower portions 18 for adjustable extension therefrom, with the upper portions 20 releaseably secured in a selected extended position in the lower portion 18 by a set screw 22 that extends through the lower portion 18 in locking engagement with the upper portion 20.

Figure 4:
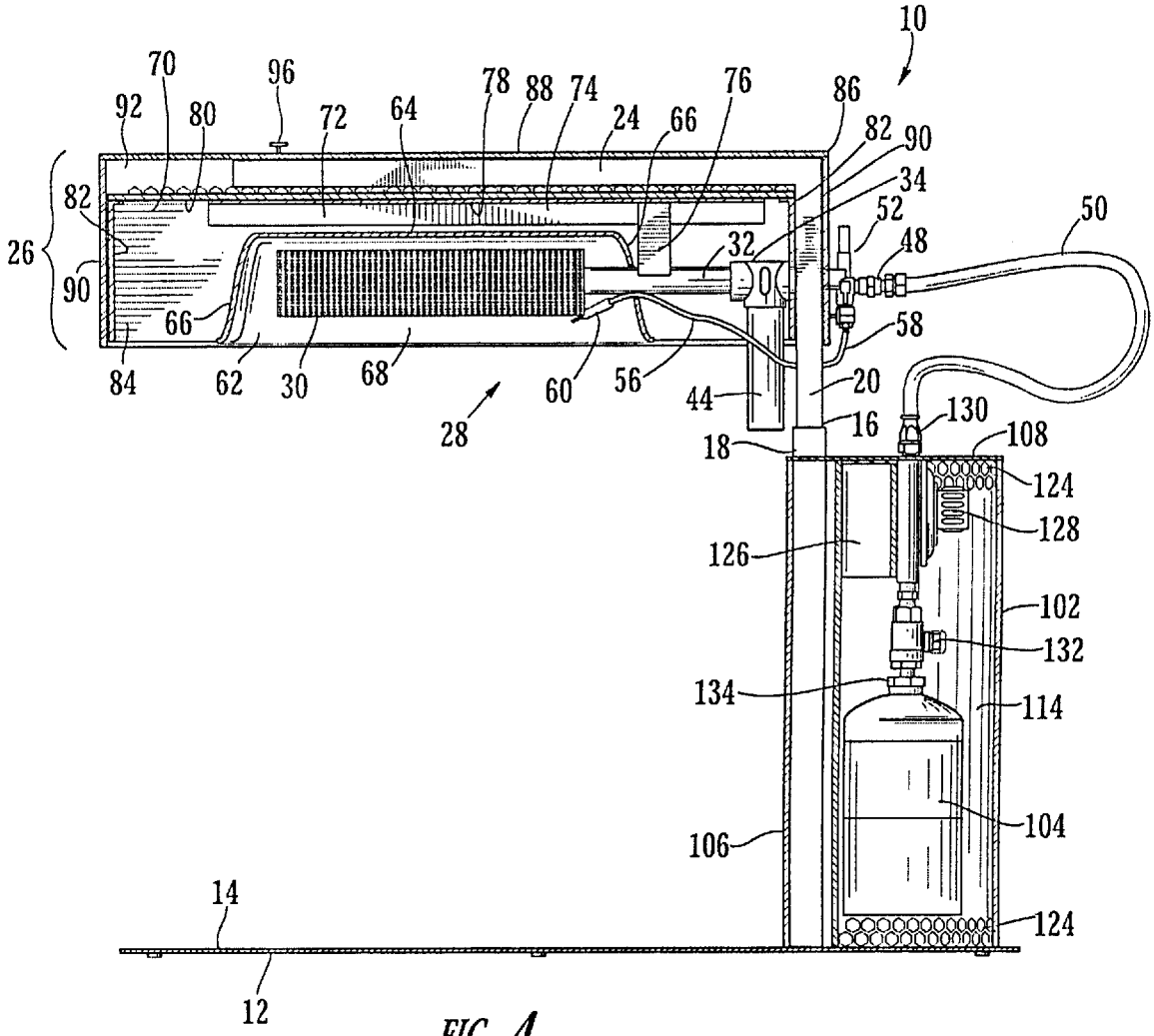
FIG. 4 is a vertical sectional view taken along line 4—4 of FIG. 1.
Figure 5:
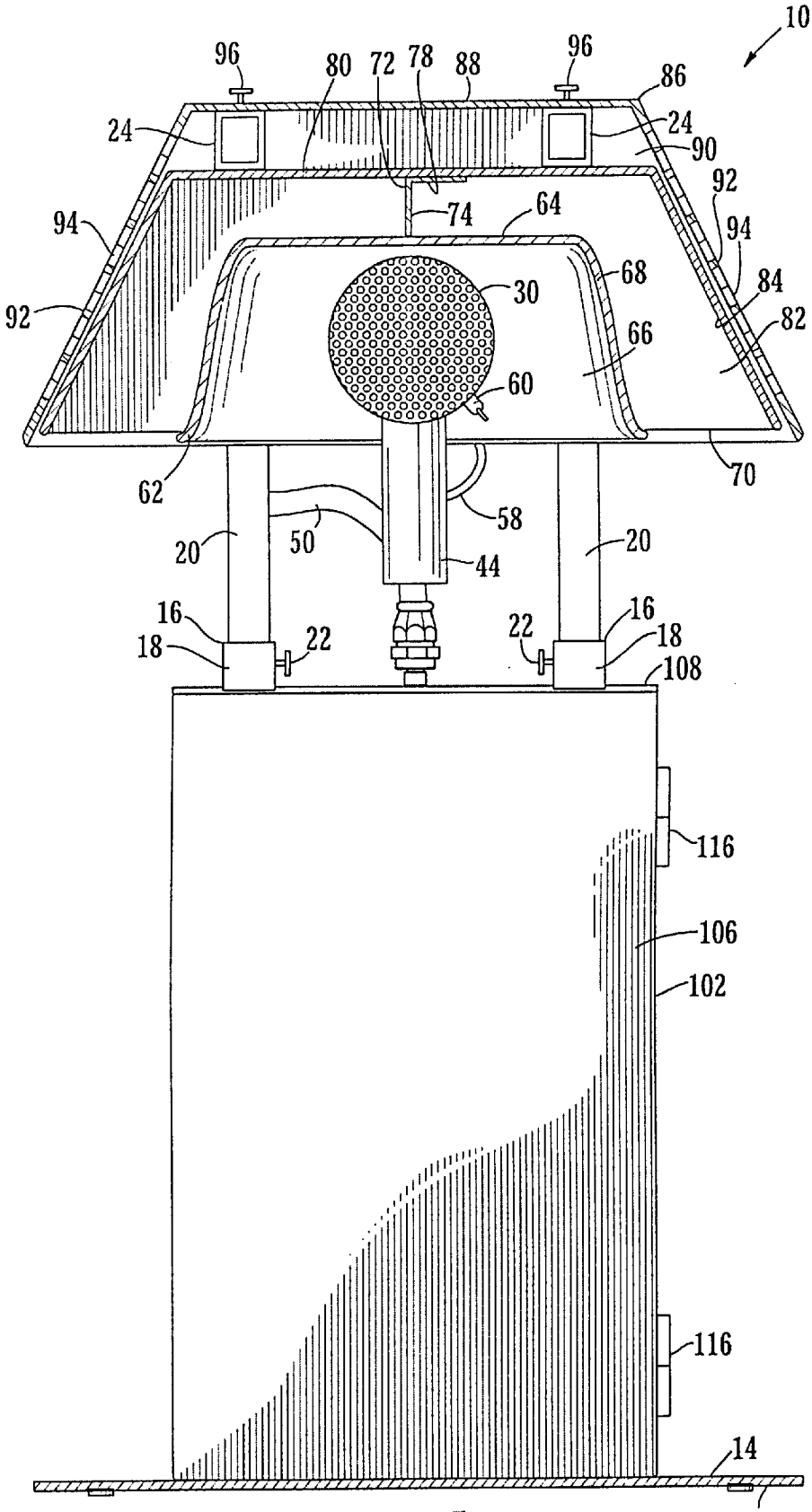
FIG. 5 is a vertical sectional view taken along line 5—5 of FIG. 2.
Figure 6:
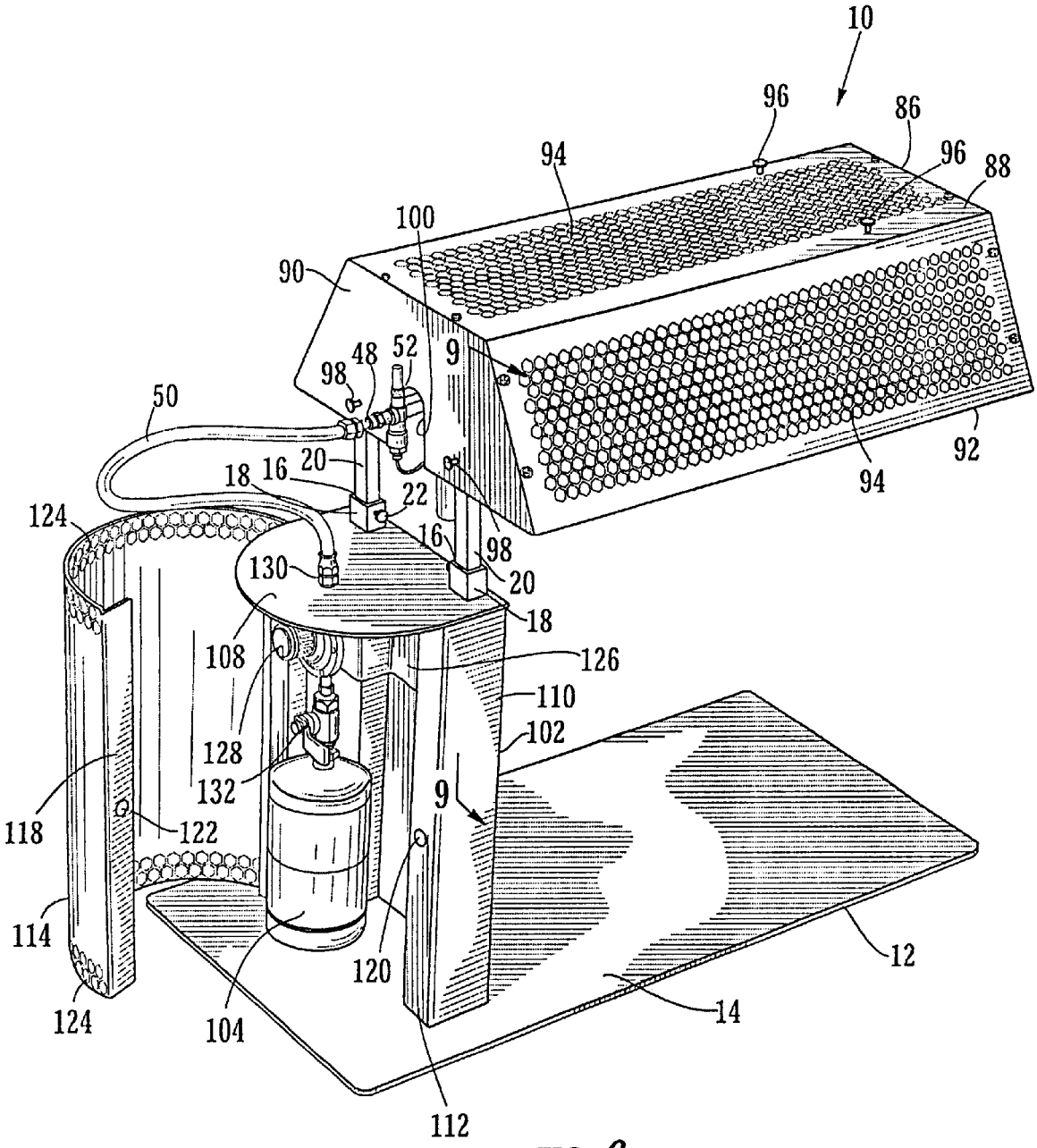
FIG. 6 is a view similar to FIG. 2 with the door of the housing open.
Figure 7:
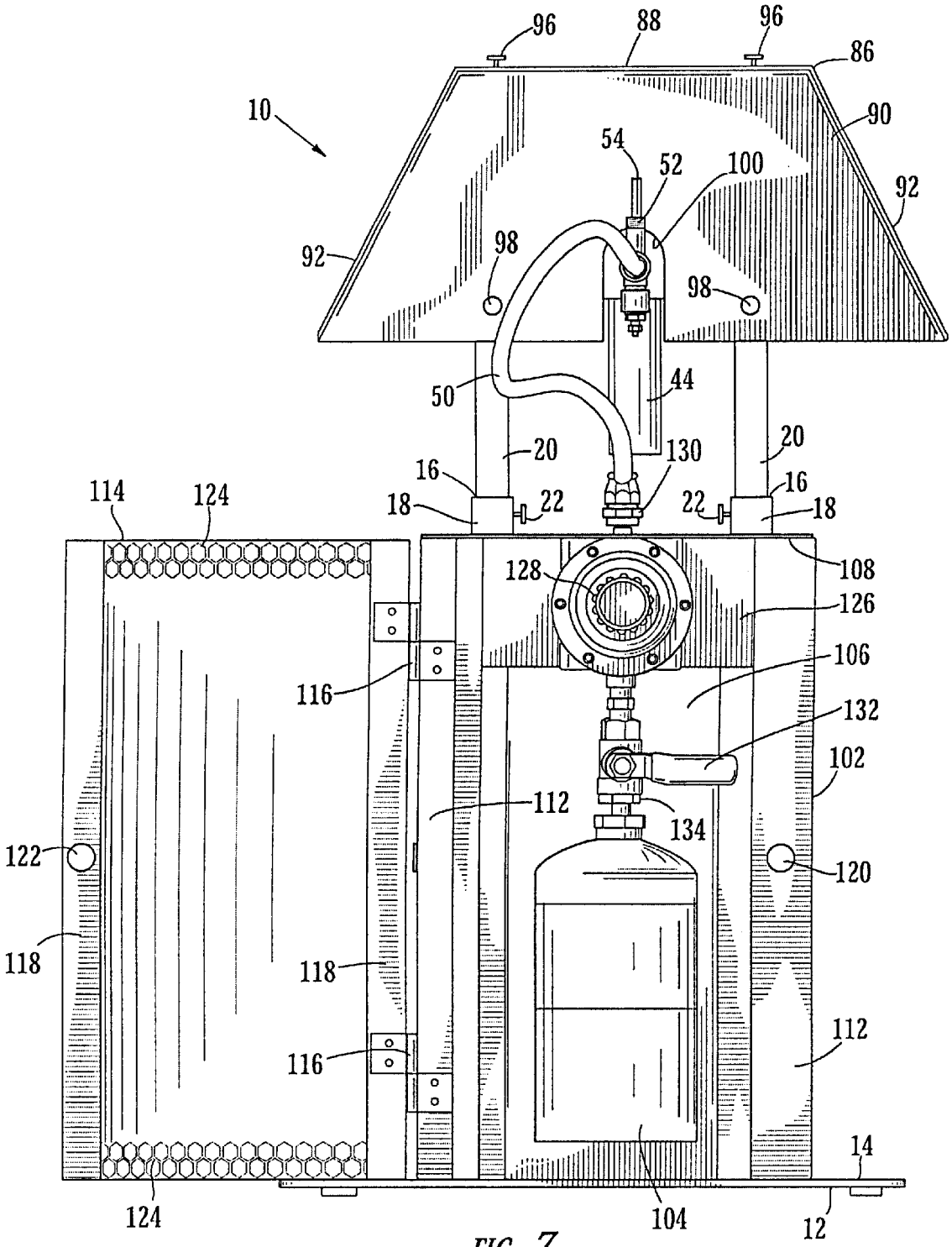
FIG. 7 is an end elevational view of the warmer of the preceding figures with the door open.
Figure 8:
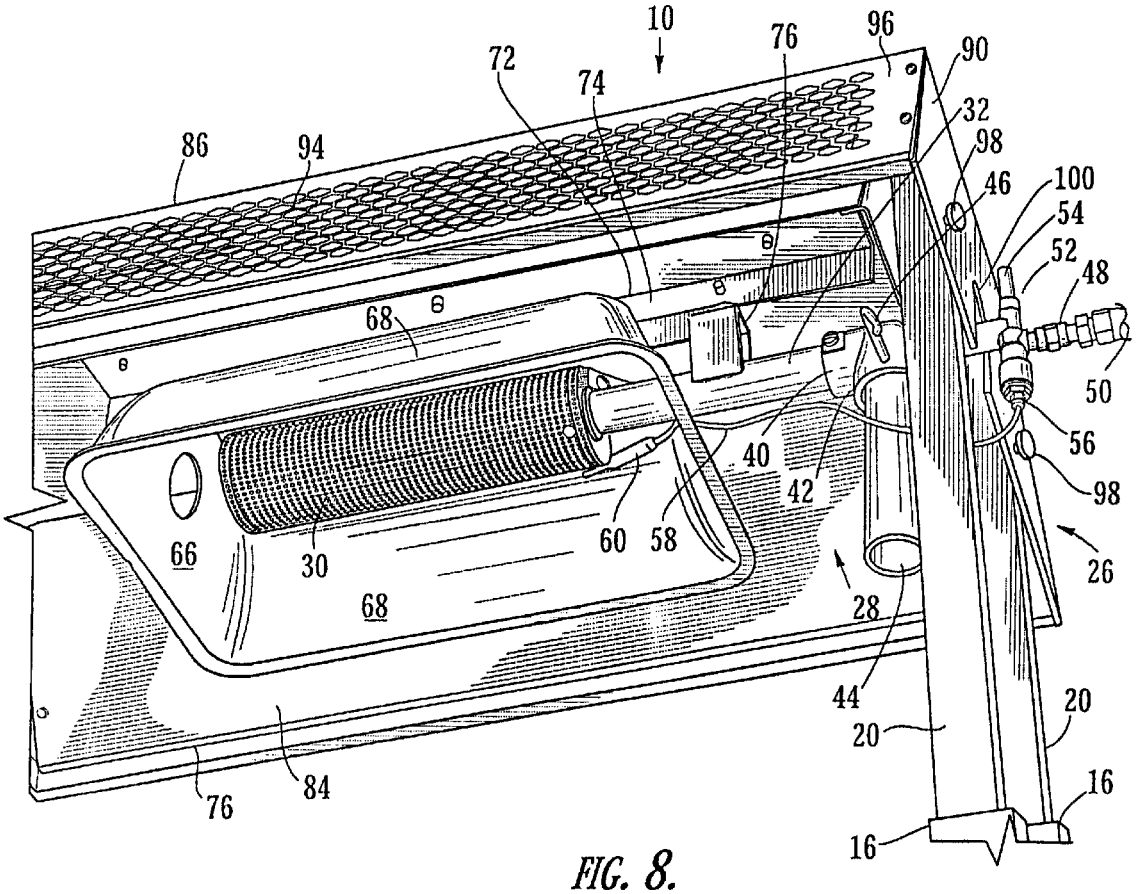
FIG. 8 is a perspective view looking upwardly into the heat generating assembly of the warmer of the preceding figures.
Figure 9:
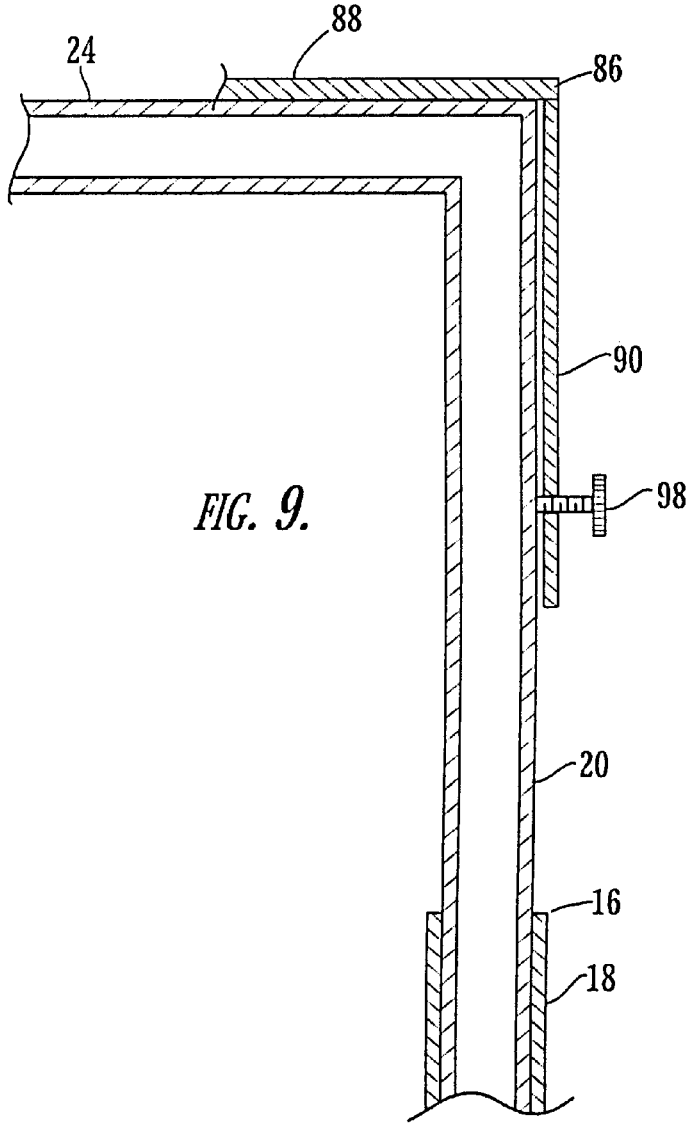
FIG. 9 is an enlarged vertical sectional view of the attachment of the protective cover to the upstanding support member of the warmer of the preceding figures taken along line 9—9 of FIG. 6.
Figure 10:
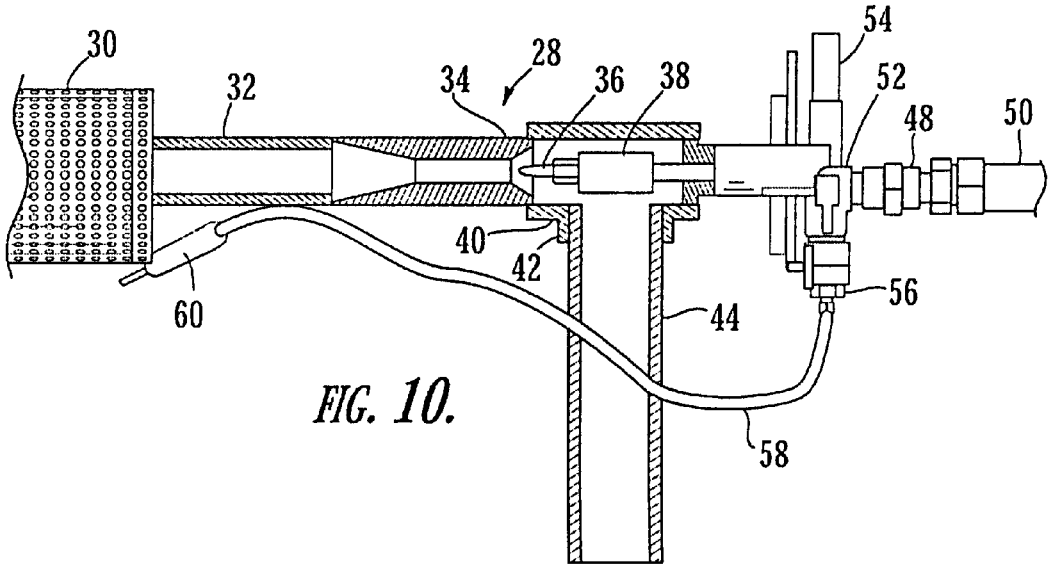
FIG. 10 is an enlarged vertical sectional view of the heat generating assembly incorporated in the warmer of the preceding figures.

As seen in FIGS. 4, 5 and 9, the two upper portions 20 are bent at approximately right angles to form horizontal extensions 24 extending over the food supporting surface 14 for supporting a heat generating assembly 26.

The heat generating assembly 26 includes a commercially available gas-fired, infrared heater system 28, such as the Type M8 Gasolec heater system marketed by Gasolec B. V. of Bodegraven, The Netherlands. This system 28 includes a gas-fired, infrared heat generating element in the form of a cylindrical burner 30, whose axis extends parallel to the food supporting surface 14 at a spacing therefrom, and receives a gas and air mixture through a burner pipe 32 from a venturi section 34 into which gas is fed through a jet 36 mounted in a jet holder 38. The jet holder 38 is mounted in a tee-piece 40 that has a downwardly opening portion 42 in which a vertically extending air intake pipe 44 is received and removably fixed by a set screw 46 extending through the downwardly portion 42 of the tee-piece 40 into engaging contact with the air intake pipe 44.

Gas is fed to the jet 36 through a connection 48 from a gas supply tube 50. The connection 48 includes a safety device 52 that has a plunger 54, which normally acts to block gas flow to the jet 36, but, when the plunger 54 is depressed, it opens the connection 48 for flow of gas therethrough to the jet 36. An interior spring (not shown) normally maintains the plunger 54 in its gas flow blocking position. A thermocouple 56 is mounted in the connection 48 and has electrical wires 58 extending to a sensor head 60 disposed adjacent the cylindrical burner 30. When the sensor head senses heat generated by the burner 30, the thermocouple 56 activates a magnet (not shown) in the connection 48 that magnetically holds the plunger 54 in gas flow open condition. Should the burner cease generating heat inadvertently or when the gas supply is shut off, the thermocouple 56 cools and, thereby, releases the magnet, which in turn releases the plunger 54 to be urged by the interior body spring to its outer gas flow blocking position. This control of gas flow is conventional and is included in the aforesaidmentioned Type M8 Gasolec heater.

The burner 30, which is a gas-fired, infrared heat generating element, is partially enclosed by a reflector 62 that is mounted on the burner pipe 32. The reflector 64 has a top panel 64 above the burner 30, end panels 66 extending from the top panel 64 downwardly at a spacing from the burner 30 to level below the level of the burner 30, and side panels 68, vertically coextensive with the end panels 66. The bottom of the reflector 62 is open to expose the supporting surface 14 to the infrared heat directly from the burner and to reflect infrared heat indirectly from the burner to the food supporting surface 14. This reflector 62 is also part of the commercially available heater system.

In the preferred embodiment of the present invention, the commercial heating system 28 is mounted in spaced relation to a heat shield 70 by means by an angle iron 72 having a vertical leg 74 extending longitudinally and secured centrally to the outer surface of the top panel 64 by the reflector 62. A bracket 76 secured to the burner pipe 32 is also secured to the vertical leg 74 of the angle iron 72. Thus, the heater system 28 is suspended from the angle iron 72.

The angle iron 72 has an upper horizontal leg 78 extending longitudinally and secured centrally to the underside of the top panel 80 of the heat shield, thus spacing the heat shield 70 from the reflector 62.

The heat shield has end panels 82 and side panels 84 spaced from the corresponding panels of the reflector 62 and extending downwardly to generally the same level as the reflector panels 64, 66, respectively. The heat shield 70 is secured to and suspended from the horizontal extensions 24 of the support member bars 16, the under sides of the support member bar extensions 24 being secured to the top panel 80 of the heat shield 70.

A protective cover 86 encloses the heat shield 70 and is removably secured to the support member bars 16. The cover 86 has a top panel 88 supported on the top surface of the horizontal extensions 24 of the support member bars 16, which results in the top panel 88 of the cover 86 being spaced from the top panel 80 of the heat shield. The cover 86 has end panels 90 and side panels 92 corresponding to the end panels 82 and side panels 84 of the heat shield 70 and spaced slightly therefrom and extending downwardly to generally the same level. The top panel 88 and side panels 92 of the cover 86 are perforated substantially throughout their extent as indicated by the perforations 94. These perforations allow air circulation for heat dissipation so that the cover 86 remains cool enough to be touched when the burner 30 is in operation.

The cover 86 is removable by the use of set screws 96 that extend through the top panel 88 of the cover 86 for releasable engagement of the horizontal extensions 24 of the support member bars 16, and end set screws 98 that extend through the end panel 90 adjacent to the vertical portions of the upper portions 20 of the support member bars 16. This end panel 90 has a U-shaped cut-out 100 to permit removal of the cover 86 without having to disassemble the components of the heater system 28.

The gas supply tube 50 is connected to a safety device 52 for feeding gas to the heater system 28 and extends exteriorly of the cover 86 to a housing 102 that is secured to and extends vertically from the base 12. The housing 102 is disposed outward of the footprint of the area of the warmer surface 14 on which food is to be warmed and is of a vertical and horizontal size for containing a gas supply canister 104, such as a one pound gas cylinder. The housing 102 has an upstanding end panel 106 secured to the inner side of the lower portions 18 of the support member bars 16 and has a top panel 108 through which the lower portions 18 of the support member bars 16 extend sufficiently for the set screws 22 to be manually accessible for adjustably releasing and tightening the telescoping lower and upper portions 18, 20 of the support member bars 16 to adjust the distance between the heat warming surface 15 and the burner 30 as desired for the particular circumstances.

The housing 102 has side panels 110, 112, with inturned, vertically extending, flanges, to one of which is hinged a semi-circular door 114 by a pair of vertically spaced lift-off hinges 116 mounted on the one inturned vertical flange 112 and to a corresponding one of the inturned flanges 118 on the door 114. The other inturned flange 112 of the side panel 110 of the housing 102 has a generally centrally located magnet element 120 that is aligned with a corresponding magnet element 122 on the other inturned flange 118 of the door 114 so that when the door is closed, the magnet elements 120 and 122 will releasably hold the door in a closed position. There are two rows of horizontally extending perforations 124 extending along both the top and bottom portions of the door 114 for air circulation when the door 114 is closed.

A mounting bracket 126 is attached to lower portions 18 of the support member bars 16 within the housing 102 adjacent the top panel 108. Mounted on this bracket 126 is a gas flow regulator 128, which may be any suitable commercially available gas flow regulator such as the PR 531 gas regulator marketed by Gasolec.

The aforementioned gas supply tube 50 extends to a connection 130 at the top panel 108 of the housing 102 and is of sufficient length to accommodate adjustments of the height of the burner system 28. The connection 130 connects the gas supply tube 50 to the gas flow regulator 128, which in turn is connected through an on-off valve 132 to a connection 134 to which the gas supply canister 104 may be removably attached and suspended.

In use, the portable warmer 10 of the preferred embodiment of the present invention is first placed at a desired location inside or outside a building without restriction as to the availability of a supply of fuel. With a canister 104 attached, the on-off valve 132 is turned on. The gas flows through the regulator 128, which is set to a desired gas flow. The burner 30 is then ignited by depressing the plunger 54 of the safety device 52 and holding it depressed while lighting the gas that is flowing into the burner 30 by use of any suitable lighting means, such as a cigarette lighter. The plunger 54 is held down for a sufficient time, such as 15 seconds, for the heat of the burner 30 to cause the thermocouple 56 to activate the magnet in the safety device 52 to maintain the plunger 54 in its depressed position allowing flow of gas from the canister 104 to the burner 30.

At the end of use of the burner, the on-off valve 132 is closed, cutting off flow of gas to the burner 30, which then ceases to generate heat, which in turn results in cooling of the thermocouple 56 to release the plunger 54 of the safety device 52 and close the feed of gas there-past. Should the burner 30 cease to function during expected operation with the on-off valve 132 open, the thermocouple 56 will function to release the safety device 52 to stop the flow of gas from the gas supply tube 50 to the burner 30. When the gas canister 104 is depleted, it can easily be exchanged with a full canister.

It should be understood that a food warmer as referred to herein includes not only a warmer for prepared food in bowls or dishes but also food being maintained warm during carving with the warmer being used as a carving station. It also should be understood that the warmer presently mentioned can be used to warm other products and is not to be limited to the details of the preferred embodiment described above.

It will therefore be understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and equivalents thereof

What is claimed is:

1. A gas-fired, infrared, warmer, comprising:

a base having a product supporting surface;

a support member mounted on said base and projecting therefrom to a location spaced from said product supporting surface;

a gas-fired, infrared heat generating assembly supported by said support member in facing relation to said product supporting surface at said spaced location;

said assembly including a gas-fired, infrared heat generating element and a reflector disposed in spaced relation about said element and being open to expose said product supporting surface to infrared heat from said heat generating element and to infrared heat reflected by said reflector;

a mounting for replaceably mounting a gas supply canister on said warmer; and a gas conduit connectable between said mounted gas canister and said heater generating element.

2. The portable, gas-fired, infrared, warmer of claim 1 further comprising said assembly including a heat shield spaced from and extending about said reflector.

3. The portable, gas-fired, infrared, warmer of claim 2 further comprising said assembly including a protective cover spaced from and extending about said heat shield.

4. The portable, gas-fired, infrared, warmer of claim 3 further comprising said protective cover being perforated for air circulation therethrough.

5. The portable, gas-fired, infrared, warmer of claim 1 further comprising said support member being adjustable to adjust the space between said support surface and said heat generating assembly.

6. The portable, gas-fired, infrared, warmer of claim 5 further comprising said support member being one or more telescopingly extendible bars.

7. The portable, gas-fired, infrared, warmer of claim 6 further comprising a pair of spaced said telescopingly extendible bars.

8. The portable, gas-fired, infrared, warmer of claim 1 further comprising an on-off valve and a gas flow regulator disposed on said warmer for controlling gas flow in said conduit.

9. A portable, gas-fired, infrared, warmer, comprising:

a portable base having a product supporting surface;

a support member mounted on said base and projecting therefrom to a location spaced from said product supporting surface;

a gas-fired, infrared heat generating assembly supported by said support member in facing relation to said product supporting surface at said spaced location;

said assembly including a gas-fired, infrared heat generating element and a reflector disposed in spaced relation about said element and being open to expose said product supporting surface to infrared heat from said heat generating element and to infrared heat reflected by said reflector;

a mounting for replaceably mounting a gas supply canister on said warmer for portability therewith; and a gas conduit connectable between said mounted gas canister and said heat generating element.

10. A portable, gas-fired, infrared, food warmer, comprising:

a portable base having an upwardly facing food supporting surface;

a support member mounted on said base and projecting upwardly therefrom to a location spaced upwardly from said food supporting surface;

a gas-fired, infrared heat generating assembly supported by said support member in facing relation to and above said food supporting surface at said spaced location;

said assembly including a gas-fired, infrared heat generating element and a reflector disposed in spaced relation about said element and being open downwardly to expose food on said supporting surface to infrared heat directly from said heat generating element and to infrared heat reflected by said reflector;

a mounting for replaceably mounting a gas supply canister on said warmer for portability therewith; and a gas conduit connectable between said mounted gas canister and said heat generating element.

11. The portable, gas-fired, infrared, food warmer of claim 10 further comprising said mounting being disposed to mount a gas canister adjacent said upwardly projecting support member.

12. The portable, gas-fired, infrared, food warmer of claim 11 further comprising said mounting being attached to said upwardly projecting support member.

13. The portable, gas-fired, infrared, food warmer of claim 12 further comprising; an upstanding housing enclosing said mounting and providing space for mounting of a gas canister therein.

14. The portable, gas-fired, infrared, food warmer of claim 13 further comprising said upstanding housing enclosing said projecting support member, with said support member extending upwardly beyond said housing.

15. The portable, gas-fired, infrared, food warmer of claim 13 further comprising said housing having a door openable to insert gas canisters into and remove gas canisters from said housing.

16. The portable, gas-fired, infrared, food warmer of claim 10 further comprising said assembly including a heat shield spaced from and extending about said reflector.

17. The portable, gas-fired, infrared, warmer of claim 16 further comprising said assembly including a protective cover spaced from and extending about said protective shield.

18. The portable, gas-fired, infrared, food warmer of claim 17 further comprising said protective cover being perforated for air circulation therethrough.

19. The portable, gas-fired, infrared, food warmer of claim 10 further comprising said support member being adjustable to adjust the space between said support surface and said heat generating assembly.

20. The portable, gas-fired, infrared, food warmer of claim 19 further comprising said support member being one or more upwardly extending telescopingly extendible bars.

21. The portable, gas-fired, infrared, food warmer of claim 20 further comprising a pair of spaced said telescopingly extendible bars.

22. The portable, gas-fired, infrared, food warmer of claim 10 further comprising an on-off valve and a gas flow regulator disposed on said warmer for controlling gas flow in said conduit.

* * * * *